US006999706B2

(12) United States Patent
Morioka et al.

(10) Patent No.: US 6,999,706 B2
(45) Date of Patent: Feb. 14, 2006

(54) DEVELOPING DEVICE AND PROCESS CARTRIDGE INCLUDING THE SAME FOR USE IN ELECTRO PHOTOGRAPHIC IMAGE-FORMING APPARATUS

(75) Inventors: Masanari Morioka, Tokyo (JP); Yoshiyuki Batori, Tokyo (JP); Hiroki Ogino, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 10/845,817

(22) Filed: May 14, 2004

(65) Prior Publication Data

US 2004/0240909 A1 Dec. 2, 2004

(30) Foreign Application Priority Data

May 30, 2003 (JP) ..... 2003-154073

(51) Int. Cl.
*G03G 15/08* (2006.01)

(52) U.S. Cl. ..... 399/279; 399/111; 399/119; 399/286

(58) Field of Classification Search ..... 399/107, 399/111, 119, 279, 281, 286
See application file for complete search history.

(56) References Cited

U.S. PATENT DOCUMENTS 5,579,085 A * 11/1996 Miyabe et al. ..... 399/111
5,739,900 A * 4/1998 Isobe ..... 355/109
6,101,348 A * 8/2000 Nonaka et al. ..... 399/103
6,208,817 B1 * 3/2001 Chadani et al. ..... 399/104

* cited by examiner

*Primary Examiner*—Hoan Tran
(74) *Attorney, Agent, or Firm*—Canon U.S.A. Inc. I.P. Div

(57) ABSTRACT

A developing device for developing an electrostatic latent image formed on an electrophotographic photoreceptor includes a hollow developing roller, a support member inserted in the hollow developing roller to support the developing roller, a flange member having a first engaging portion engaging with an outer surface of the support member and a second engaging portion engaging with an inner surface of the developing roller, and a gap-holding member disposed at one end of the developing roller, the gap-holding member having an abutment abutting against the electrophotographic photoreceptor for maintaining a gap between the developing roller and the electrophotographic photoreceptor. The abutment overlaps with the second engaging portion in the longitudinal direction of the developing roller.

16 Claims, 12 Drawing Sheets

DEVELOPING DEVICE AND PROCESS CARTRIDGE INCLUDING THE SAME FOR USE IN ELECTRO PHOTOGRAPHIC IMAGE-FORMING APPARATUS

BACKGROUND OF THE INVENTION

1. Field of the Invention

The present invention relates to a developing device and a process cartridge for use in an electrophotographic image-forming system.

2. Description of the Related Art

Known is a process cartridge system in which an electrophotographic photoreceptor and a developing device are integrated in a cartridge, and the cartridge is demountable from a main body of an electrophotographic image forming apparatus. With this process cartridge system, an operator can maintain the apparatus without depending on a service engineer. Thus, this process cartridge system has been widely employed in image forming apparatuses.

The above-mentioned process cartridge system includes a developing device for developing a latent image formed on an electrophotographic photoreceptor with a developer. Such a developing device has a stationary magnet disposed in a cylindrical developing roller. By rotating the developing roller, the developer is fed to a photosensitive drum (the photoreceptor).

The support mechanism of the developing roller will be described with reference to FIGS. 11 and 12. The electrophotographic photoreceptor (not shown) is rotatably supported by the frame of the cartridge. As shown in FIG. 11, a developing roller 10*d* has gap-holding members 10*m* rotatably disposed at both ends thereof, for maintaining a predetermined gap between the electrophotographic photoreceptor and the developing roller 10*d*.

The developing roller 10*d* has developing-roller flanges 10*d*1 disposed at both ends thereof. Each developing-roller flange 10*d*1 is held by a bearing member 10*w*.

Also, the developing roller 10*d* has a stationary magnet 10*c* disposed inside thereof. The stationary magnet 10*c* is held by stationary-magnet holding members 10*c*1.

The bearing members 10*w* and the stationary-magnet holding members 10*c*1 are positioned by corresponding positioning members 10*f*5 disposed in a toner-developing frame 10*f*1. With this structure, a relative position between the developing roller 10*d* and the stationary magnet 10*c* is determined.

SUMMARY OF THE INVENTION

The present invention is directed to a developing device, a process cartridge incorporating the developing device, and an image forming apparatus incorporating the process cartridge demountable therein.

The process cartridge of the present invention maintains a uniform gap between a developing roller and an electrophotographic photoreceptor and minimizes deformation of the developing roller.

In one aspect of the present invention, the developing device includes a hollow developing roller, a support member inserted in the hollow developing roller to support the developing roller, a flange member having a first engaging portion engaging with an outer surface of the support member and a second engaging portion engaging with an inner surface of the developing roller, and a gap-holding member disposed at one end of the developing roller, having an abutment abutting against the electrophotographic photoreceptor for maintaining a gap between the developing roller and the electrophotographic photoreceptor. In one embodiment, the abutment overlaps with the second engaging portion in the longitudinal direction of the developing roller.

In another embodiment, the abutment overlaps with the first and second engaging portions in the longitudinal direction of the developing roller.

Further features and advantages of the present invention will become apparent from the following description of the preferred embodiments with reference to the attached drawings.

DESCRIPTION OF THE PREFERRED EMBODIMENTS

A developing device, a process cartridge, and an electrophotographic image forming apparatus according to one embodiment of the present invention will be described with reference to the attached drawings.

Figure 1:
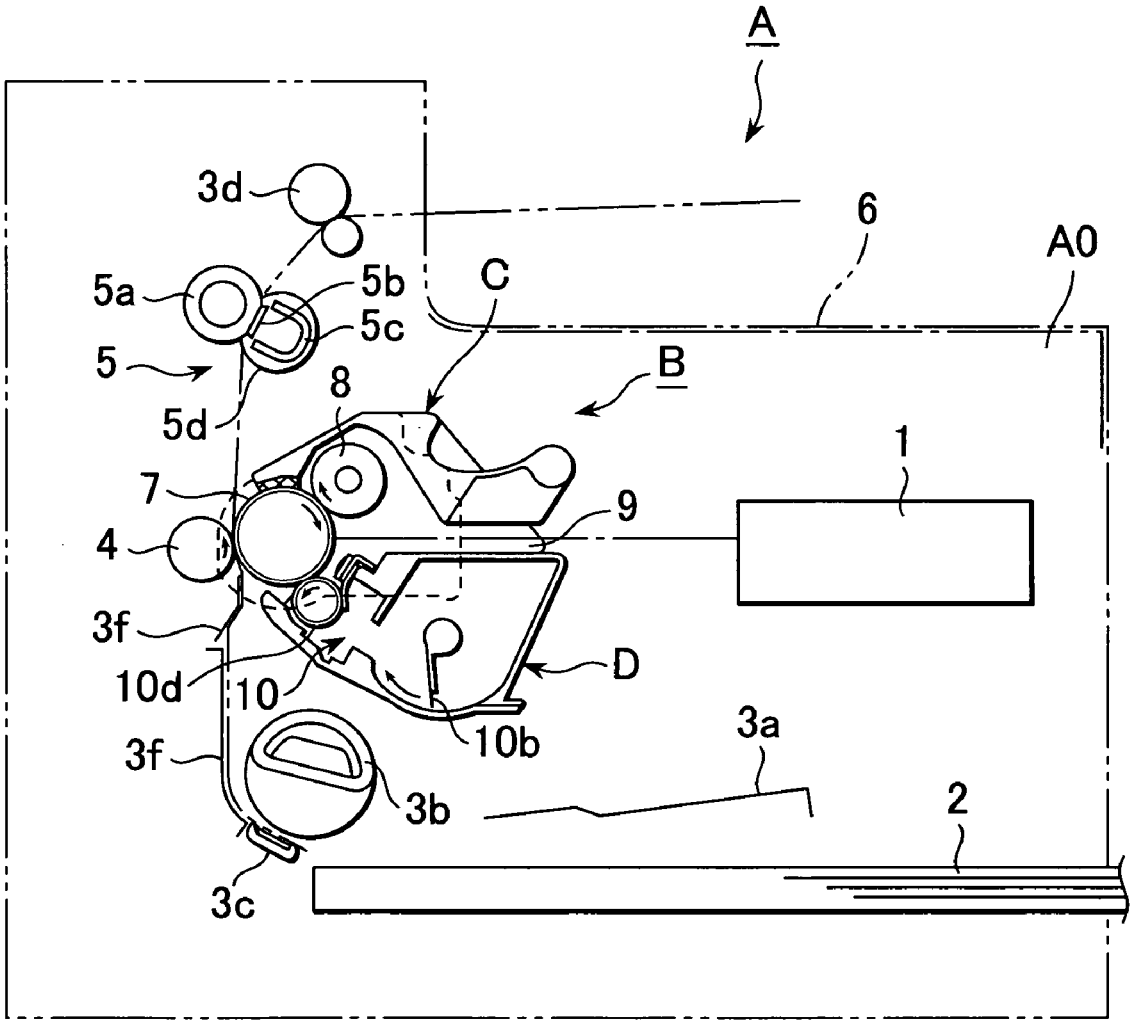
FIG. 1 is a schematic view of an image forming apparatus incorporating a process cartridge according to one embodiment of the present invention.
Figure 2:
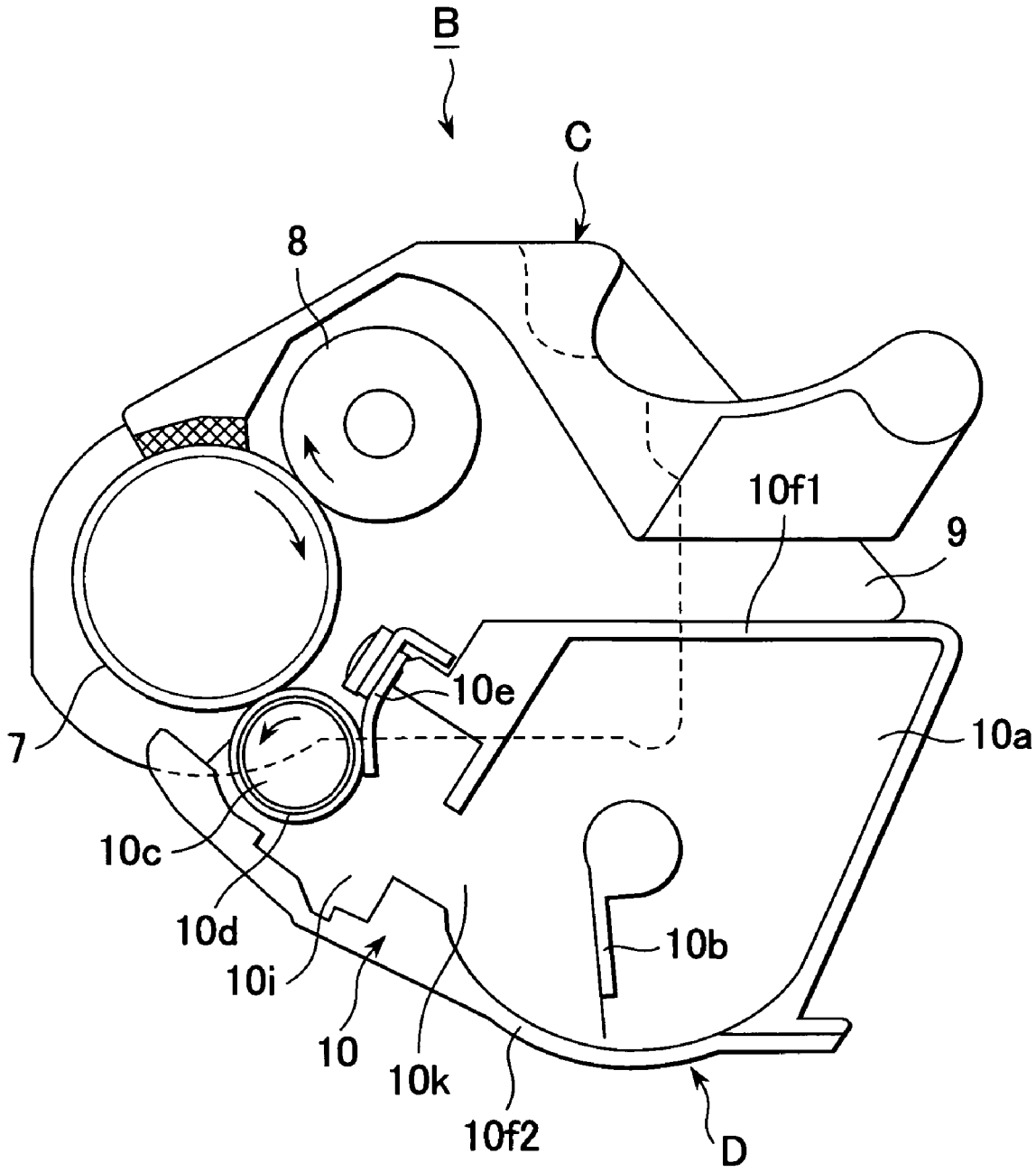
FIG. 2 is a schematic view of the process cartridge shown in FIG. 1.

FIG. 1 is a schematic view of an electrophotographic image forming apparatus A (hereinafter, sometimes simply referred to as an image forming apparatus) incorporating a process cartridge B mounted therein in accordance with one embodiment of the present invention. FIG. 2 is a schematic view of the process cartridge B shown in FIG. 1. The process cartridge B is demountable from the main body of the electrophotographic image forming apparatus A.

The process cartridge B including a developing device and the electrophotographic image forming apparatus A incorporating the process cartridge B mounted therein will be described with reference to FIGS. 1 and 2.

Image Forming Apparatus

As shown in FIG. 1, the electrophotographic image forming apparatus A includes the process cartridge B. The process cartridge B has a photosensitive drum 7 serving as an electrophotographic photoreceptor. The photosensitive drum 7, which can be composed of an aluminum alloy, has an outer photosensitive layer serving as an organic photo conductive layer.

An optical system 1 emits information-encoded light including image information onto the photosensitive drum 7 so as to form a latent image on the photosensitive drum 7. When the latent image is developed with a developer (hereinafter, referred to as toner), a toner image is formed on the photosensitive drum 7.

In synchronization with formation of the toner image, recording media 2 are separated from a feed cassette 3*a*. A pickup roller 3*b* and a pressure member 3*c* pressing against the pickup roller 3*b* feed the separated recording media 2 sheet by sheet. A transporting means 3*f* then transports each recording medium 2.

The toner image formed on the photosensitive drum 7 is transferred onto the recording medium 2 by applying a voltage on a transfer roller 4 serving as transferring means. Then, the recording medium 2 is transported to fixing means 5 by the transporting means 3*f*.

The fixing means 5 has a drive roller 5*a*, a heater 5*b*, and a fixing rotor 5*d*. The fixing rotor 5*d* includes a cylindrical sheet rotatably supported by a support member 5*c*. The fixing means 5 applies heat and pressure onto the recording medium 2 passing therethrough. The toner image transferred as described above is fixed onto the recording medium 2. Then, the recording medium 2 is transported by a pair of discharge rollers 3*d*, which discharges the recording medium 2 onto a discharge section 6.

Process Cartridge Including Developing Device

The process cartridge B according to one embodiment of the present invention includes the electrophotographic photoreceptor 7 and at least developing means 10.

As shown in FIGS. 1 and 2, the process cartridge Bincludes the photosensitive drum 7, an electrostatic charging roller 8, and the developing means 10. By rotating the photosensitive drum 7 and applying a voltage on the electrostatic charging roller 8 serving as charging means, the surface of the photosensitive drum 7 is uniformly charged. Then, an optical image from the optical system 1 is exposed onto the charged photosensitive drum 7 through an exposure opening 9. Thus, a latent image is formed on the photosensitive drum 7. The latent image formed on the photosensitive drum 7 is developed by the developing means 10.

In the present embodiment, the developing means 10 includes a toner-developing frame 10*f*1 and a lid member 10*f*2. While toner (monocomponent magnetic developer) in a toner chamber (toner storage) 10*a* is sent to a developing chamber 10*i* by a rotatable toner-transporting roller 10*b* after passing through an opening 10*k*, a developing roller 10*d* having a magnet 10*c* built therein is rotated. In addition, a developing blade 10*e* forms a toner layer containing frictional electrostatic charges on the surface of the developing roller 10*d*. Then, the toner is transferred onto the photosensitive drum 7 in accordance with the latent image. With this arrangement, the toner image is formed on the photosensitive drum 7. In other words, the latent image is developed and visualized.

Then, by applying a voltage having a reverse polarity to that of the toner image on the transfer roller 4, the toner image is transferred onto the recording medium 2. Subsequently, the photosensitive drum 7 is charged by the electrostatic charging roller 8 and is then exposed. Thus, an electrostatic latent image is formed on the photosensitive drum 7. When the electrostatic latent image is developed, the toner remaining on the photosensitive drum 7 is collected with a fog-removing bias voltage (i.e., a fog-removing potential Vback, which is a difference in a direct voltage applied on the developing device and a potential on the surface of the photoreceptor) onto the developing roller 10*d*. In the present embodiment, a cleaning blade for cleaning the toner remaining on the photosensitive drum 7 is not provided.

The process cartridge B is detachably mounted on cartridge-mounting means provided in the main body A0 of the apparatus A.

Also, the process cartridge B is formed by assembling a drum frame unit C and a developing unit D together.

Supporting Mechanism of Developing Roller

Figure 3:
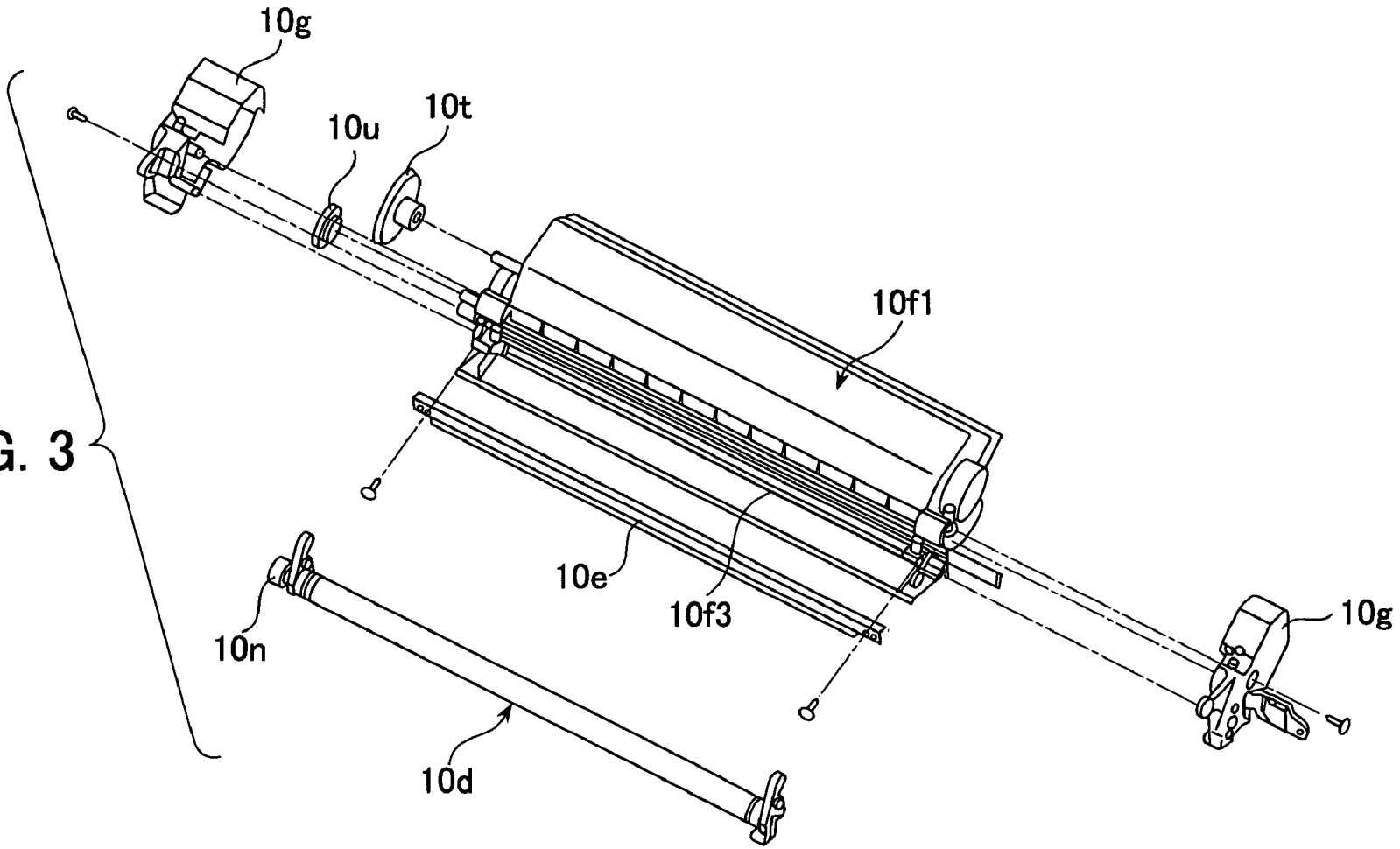
FIG. 3 is an exploded perspective view of a developing device of the process cartridge shown in FIG. 1.

FIG. 3 is an exploded perspective view of the developing device. The toner-developing frame 10*f*1 supports the developing roller 10*d* rotatably fixed in an opening 10*f*3 thereof and supports the developing blade 10*e* fixed in the same with a screw.

Both ends of the developing roller 10*d* are rotatably supported by end members 10*g* fixed to the toner-developing frame 10*f*1. A drive force is transmitted to a developing-roller gear 10*n* fixed to one end of the developing roller 10*d* via a gear train formed by idler gears 10*t* and 10*u* so as to rotate the developing roller 10*d*.

Figure 4:
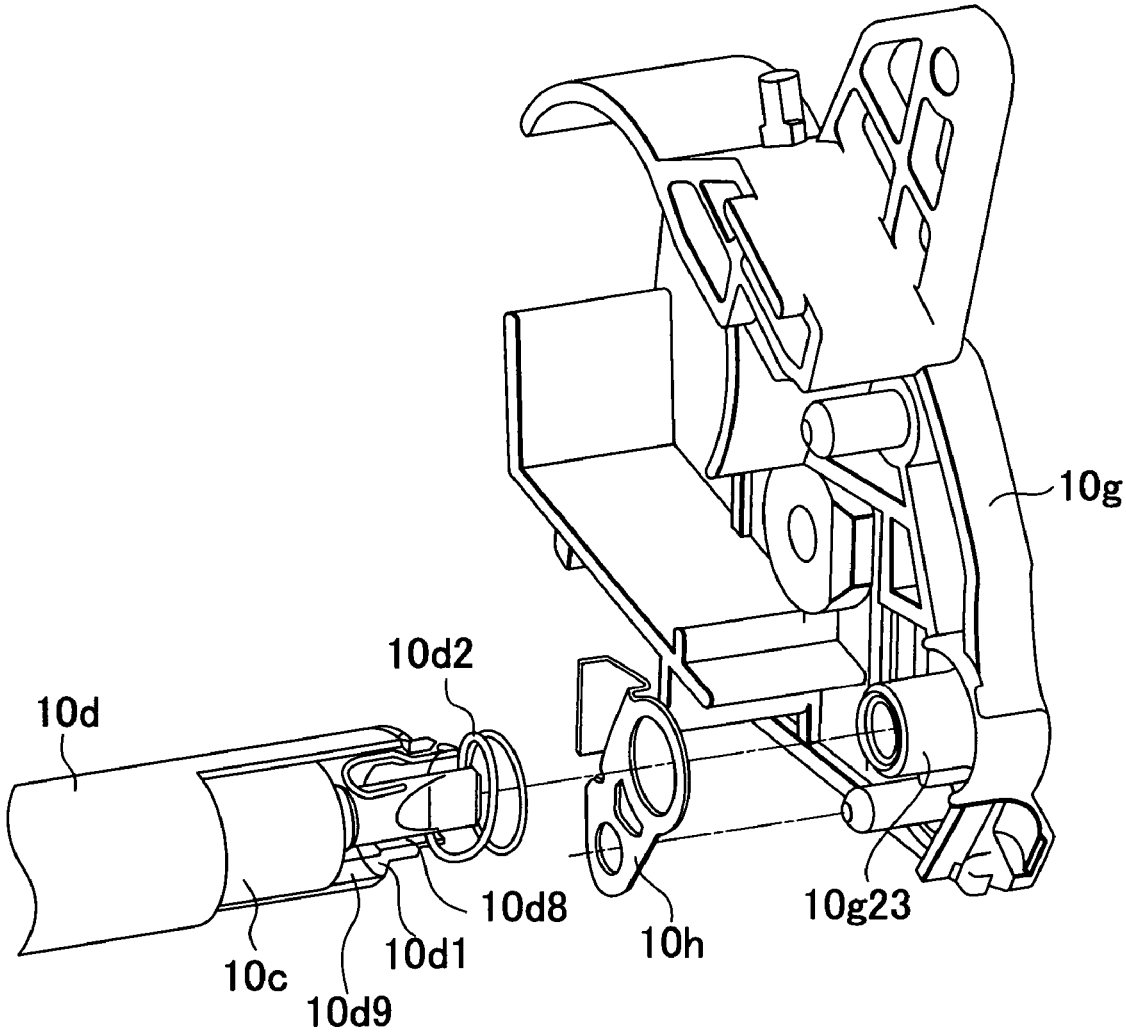
FIG. 4 is an enlarged perspective view of a supporting structure of a developing roller.
Figure 5A:
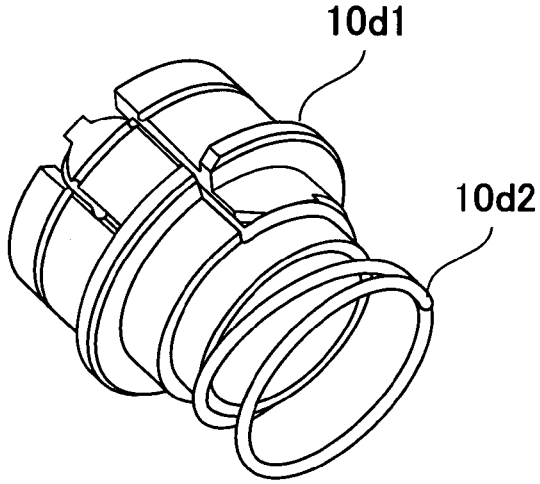
FIGS. 5A and 5B are perspective views of a developing-roller flange.
Figure 5B:
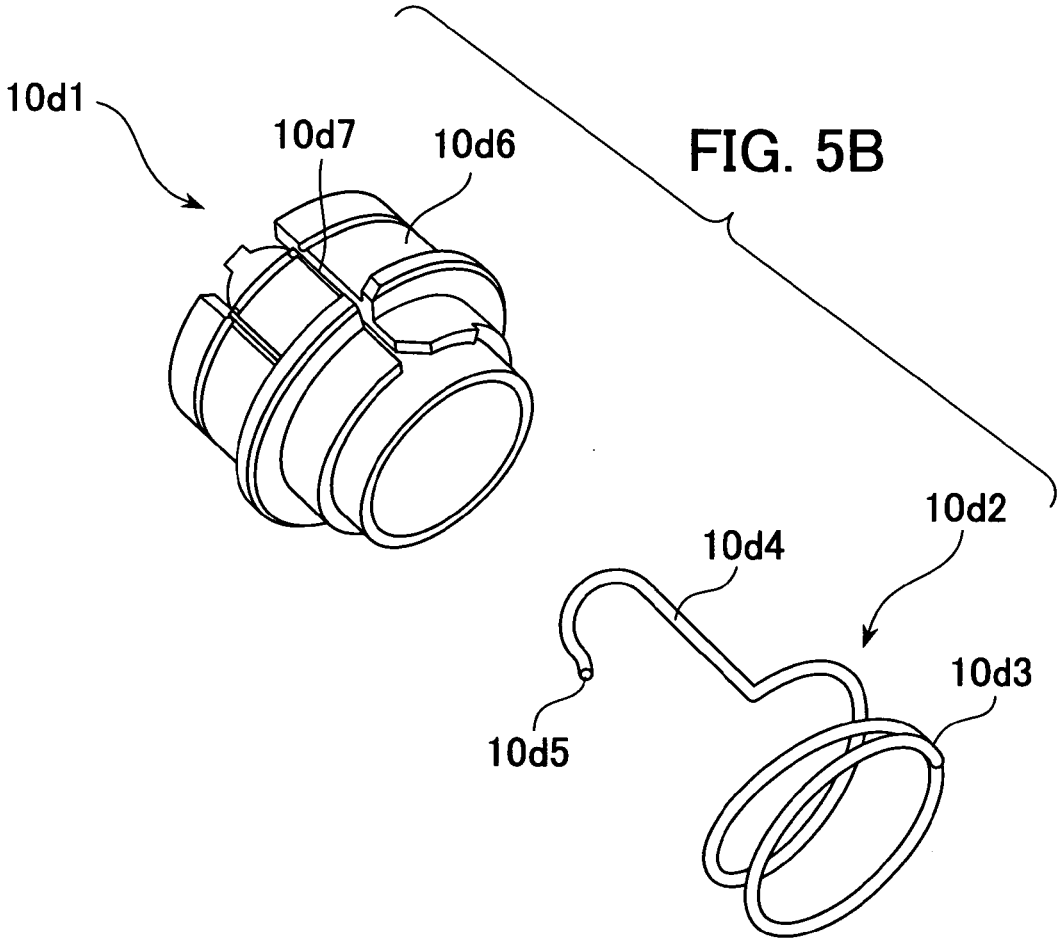

FIG. 4 is a perspective view of the support structure of the developing roller 10*d*. FIGS. 5A–B are perspective views of a developing flange 10*d*1 of the developing roller 10*d*. The developing roller 10*d* has a cylindrical developing-roller flange 10*d*1 fixed to each end thereof. The developing-roller flange 10*d*1 can be a resin-molded product. As shown in FIGS. 5A–B, the developing-roller flange 10*d*1 has a press-fit portion 10*d*6 and a groove 10*d*7 formed therein. The press-fit portion 10*d*6 is press fitted in the end of the developing roller 10*d* so as to be firmly fixed to the end. The groove 10*d*7 is used for fixing a connecting portion 10*d*4 of an electrode 10*d*2 thereto.

The electrode 10*d*2 includes first and second contacts 10*d*3 and 10*d*5 and the connecting portion 10*d*4. The first contact 10*d*3 is electrically connected to a frame-side electrode 10*h* (see FIG. 4) fixed to the corresponding end member 10*g*, and the second contact 10*d*5 is electrically connected to the developing roller 10*d*. When an electrode (not shown) of the main body and the frame-side electrode 10*h* are connected to each other, a developing bias voltage is supplied to the developing roller 10*d* via the electrode 10*d*2.

As shown in FIGS. 4 and 5A–B, the groove 10*d*7 extends longitudinally along the press-fit portion 10*d*6, and the press-fit portion 10*d*6 contacts with an inner circumferential surface 10*d*9 of the developing roller 10*d* when the developing-roller flange 10*d*1 is press-fitted into the developing roller 10*d*.

Figure 6A:
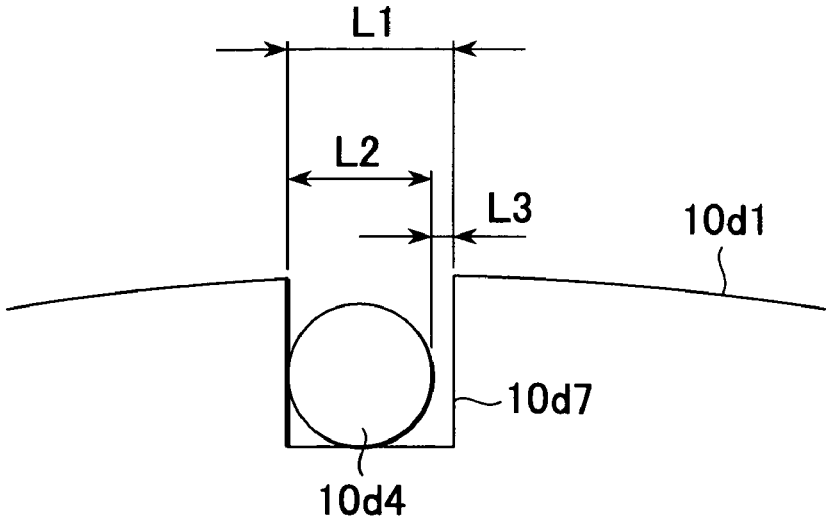
FIGS. 6A and 6B are schematic views of the developing-roller flange and an electrode.
Figure 6B:
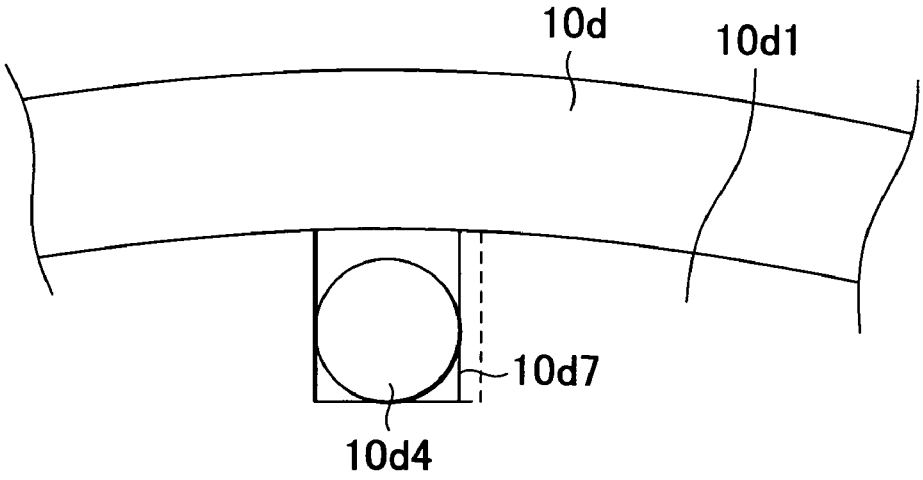

FIGS. 6A and 6B are schematic views of the developing-roller flange 10*d*1 and the connecting portion 10*d*4. FIG. 6A shows the developing-roller flange 10*d*1 in a state in which it is not press-fitted into the developing roller 10*d*. The width L1 of the groove 10*d*7 is greater than a diameter L2 of the connecting portion 10*d*4, and a gap L3 remains between the groove 10*d*7 and the connecting portion 10*d*4. In the present embodiment, the gap L3 can be about 0.01 mm to 0.0214 mm. FIG. 6B shows when the developing-roller flange 10*d*1 is press-fitted into the corresponding end of the developing roller 10*d*. As shown, the groove 10*d*7 is deformed such that the width L1 is substantially equal to the diameter L2 of the connecting portion 10*d*4, and such that the connecting portion 10*d*4 abuts against the groove 10*d*7.

Figure 7:
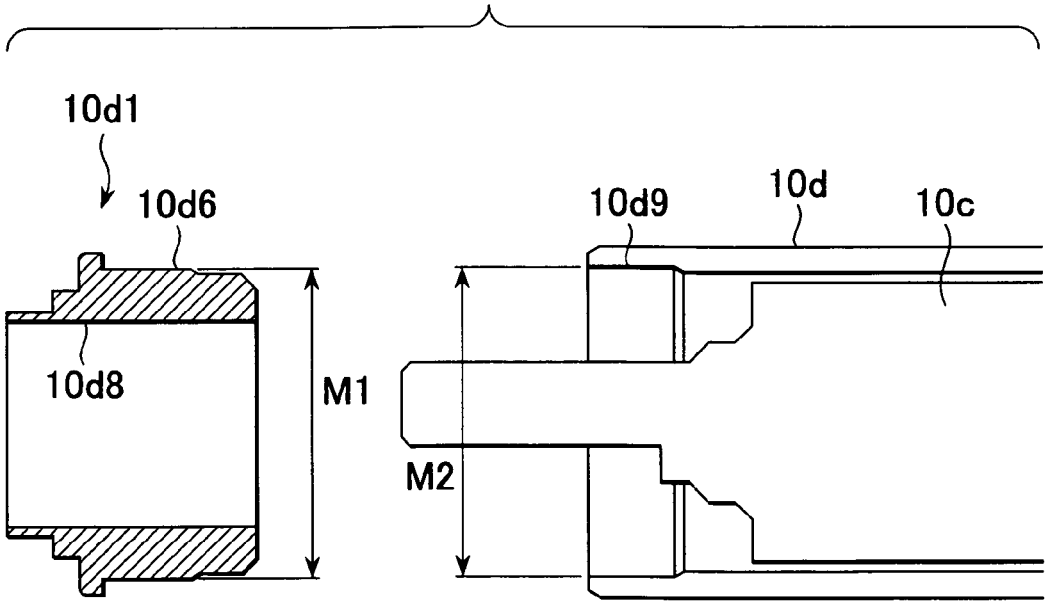
FIG. 7 is a schematic view illustrating a fixing structure of the developing-roller flange and a developing roller.

FIG. 7 is a schematic view illustrating a fixing structure of the developing-roller flange 10*d*1 and a developing roller 10*d*. A diameter M1 of the press-fit portion (outer circumference) 10*d*6 of the developing-roller flange 10*d*1 is configured larger than a diameter M2 of the inner circumferential surface (inner circumference) 10*d*9 of the corresponding end of the developing roller 10*d* when the flange 10*d*1 is not yet press fitted into the roller 10*d*. A difference between the diameters M1 and M2 serves as a press-fit interference M3.

In the present embodiment, when the developing-roller flange 10*d*1 is press-fitted into the corresponding end of the developing roller 10*d*, the resin-molded developing-roller flange 10*d*1 is deformed by the inner circumferential surface 10*d*9. Stress is concentrated in the groove 10*d*7, possibly deteriorating the round shape of the press-fit portion 10*d*6. Also, the roundness of the end of the developing roller 10*d* into which the corresponding developing-roller flange 10*d*1 is press-fitted may deteriorate, in addition to possibly deteriorating the roundness of an inner circumferential surface 10*d*8 of the developing-roller flange 10*d*1.

In order to minimize deterioration of the above-mentioned roundness, the gap L3 is set so as to be smaller than the press-fit interference M3. With this configuration, when the developing-roller flange 10*d*1 is press-fitted into the developing roller 10*d*, the connecting portion 10*d*4 always abuts against the groove 10*d*7, thereby minimizing deterioration of the roundness of the press-fit portion 10*d*6 of the developing-roller flange 10*d*1.

Figure 8:
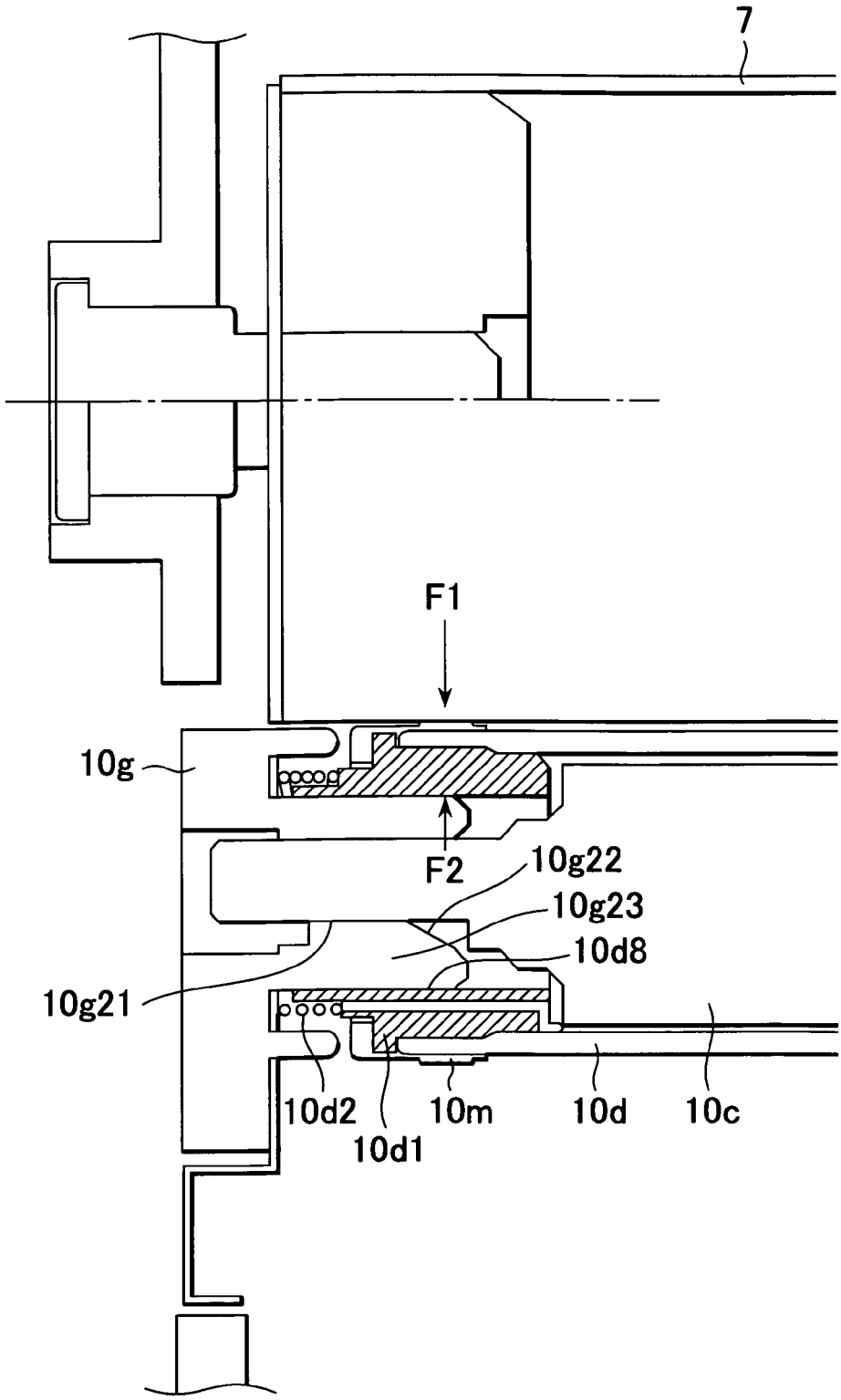
FIG. 8 is a sectional view illustrating the supporting structure of the developing roller.

FIG. 8 is a sectional view illustrating the support structure of the developing roller 10*d*. As shown in FIGS. 4 and 8, in order to rotatably support the developing roller 10*d* having the flanges 10*d*1 fixed thereto, each end member 10*g* has a projection 10*g*23 protruding therefrom, serving as a developing-roller support member. When the projection 10*g*23 is inserted along the inner circumferential surface 10*d*8 of the flange 10*d*1, the outer circumference of the projection 10*g*23 rotatably supports the developing roller 10*d*.

Figure 9:
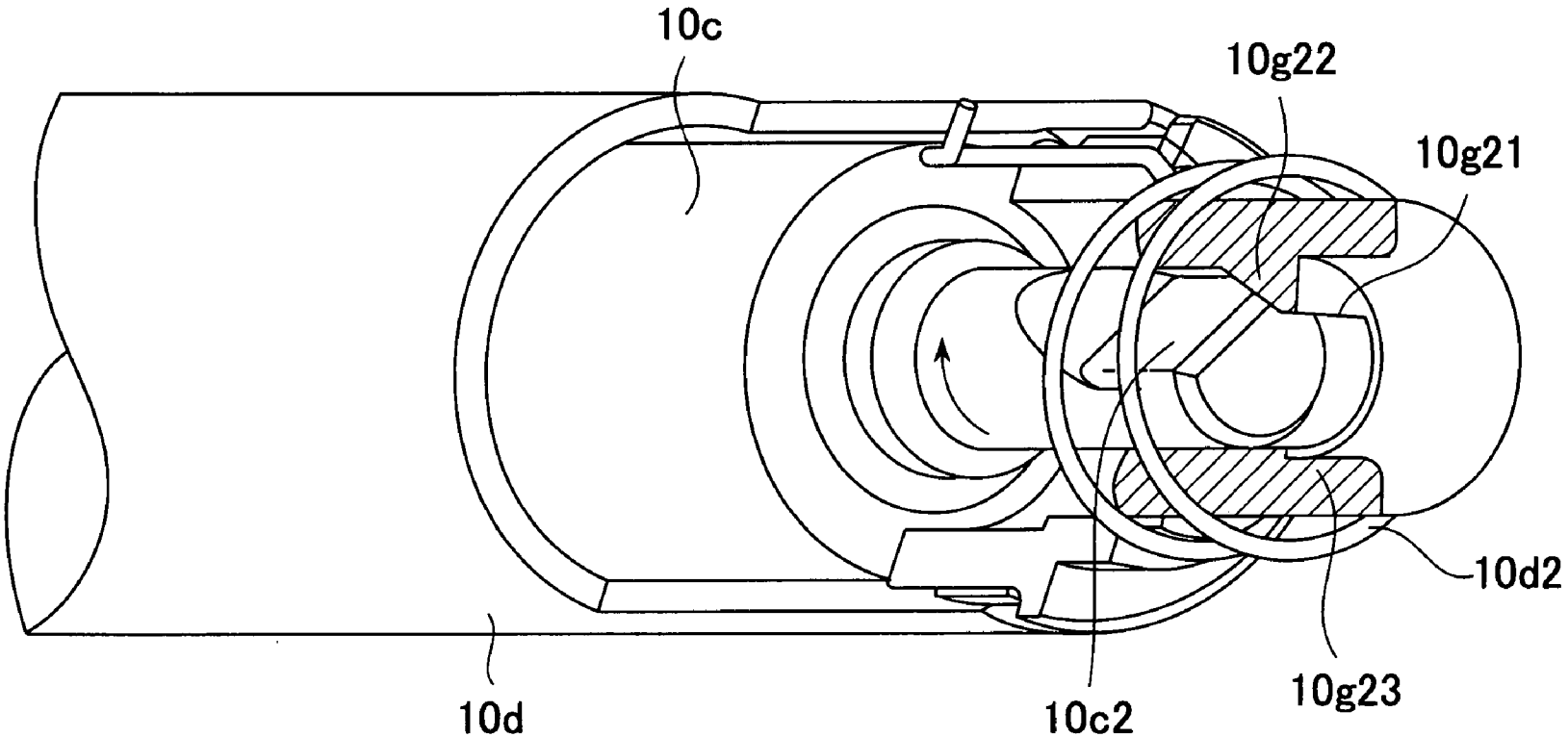
FIG. 9 is a sectional view illustrating assembly of the developing roller.

Each end member 10*g* has a guide 10*g*22 disposed therein, supporting and positioning the stationary magnet 10*c* disposed in the developing roller 10*d*. The shape of the guide 10*g*22 will be described with reference to FIG. 9. FIG. 9 is a sectional perspective view illustrating assembly of the developing roller 10*d*. FIG. 9 illustrates a D-cut phase-adjusting member 10*c*2 formed at one of the ends of the stationary magnet 10*c* and a D-cut phase-adjusting member 10*g*21 formed in the inner circumference of the projection 10*g*23. Also, FIG. 9 illustrates the phase-adjusting member 10*c*2 inserted out of phase with the projection 10*g*23.

The projection 10*g*23, with a hollow structure, has the guide 10*g*22 disposed in the inner circumference thereof. The guide 10*g*22 has a slope for guiding the phase-adjusting member 10*c*2 so as to be in concert with the phase-adjusting member 10*g*21.

As the stationary magnet 10*c* is further inserted from the position shown in FIG. 9, the geometric shape of the guide 10*g*22 facilitates rotation of the end of the stationary magnet 10*c* in a direction shown by the arrow indicated in FIG. 9, for example. As the stationary magnet 10*c* is still further inserted, the stationary magnet 10*c* engages with the phase-adjusting member of the end member 10*g*, thereby smoothly assembling the stationary magnet 10*c* into the end member 10*g*.

Referring to FIG. 8, the developing roller 10*d* has gap-holding members 10*m* provided at both ends thereof. With the gap-holding members 10*m*, the developing roller 10*d* and the photosensitive drum 7 are separated from each other by a fine gap therebetween. In the present embodiment, each gap-holding member 10*m* is a capped roller having a cap shape, fitted into and fixed to the corresponding end of the developing roller 10*d*. A part of the capped roller protrudes outward with a predetermined width and is pressed against the circumferential surface of the photosensitive drum 7.

With this structure, as shown in FIG. 8, the developing roller 10*d* receives a force F1 from the photosensitive drum 7 via the gap-holding members 10*m*, and the projections 10*g*23 of the end members 10*g* serving as support members of the developing roller 10*d* apply a reaction force F2 opposing the force F1. In this state, each projection 10*g*23 lies in the inner circumference of the corresponding developing-roller flange 10*d*1. Thus, the projection 10*g*23 supports the vicinity of a part (corresponding to the gap holding member 10*m*) pressed by the photosensitive drum 7, of the inner circumference of the corresponding flange 10*d*1. As such, a torque generated in the developing roller 10*d* is minimized as compared to the conventional case where the developing roller 10*d* is externally supported in the axial direction thereof.

Thus, deformation of the developing roller 10*d* is minimized, so that the gap between the photosensitive drum 7 and the developing roller 10*d* is more uniformly maintained. Further, since the projection 10*g*23 lies closer to the corresponding gap-holding member 10*m* in the axial direction of the developing roller 10*d*, the above advantage can be more effectively achieved. Accordingly, the gap-holding member 10*m* and the corresponding projection 10*g*23 should be configured to overlap completely with each other.

As previously described, the inner circumference of the projections 10*g*23 supports the stationary magnet 10*c* and determines the rotating direction and the center position of the stationary magnet 10*c*. That is, a single member positions two components (the stationary magnet 10*c* and the developing roller 10*d*) as described above. As a result, the relative position between these two components is achieved more accurately, thereby leading to a uniform magnetic-force distribution on the surface of the developing roller 10*d*.

Figure 10:
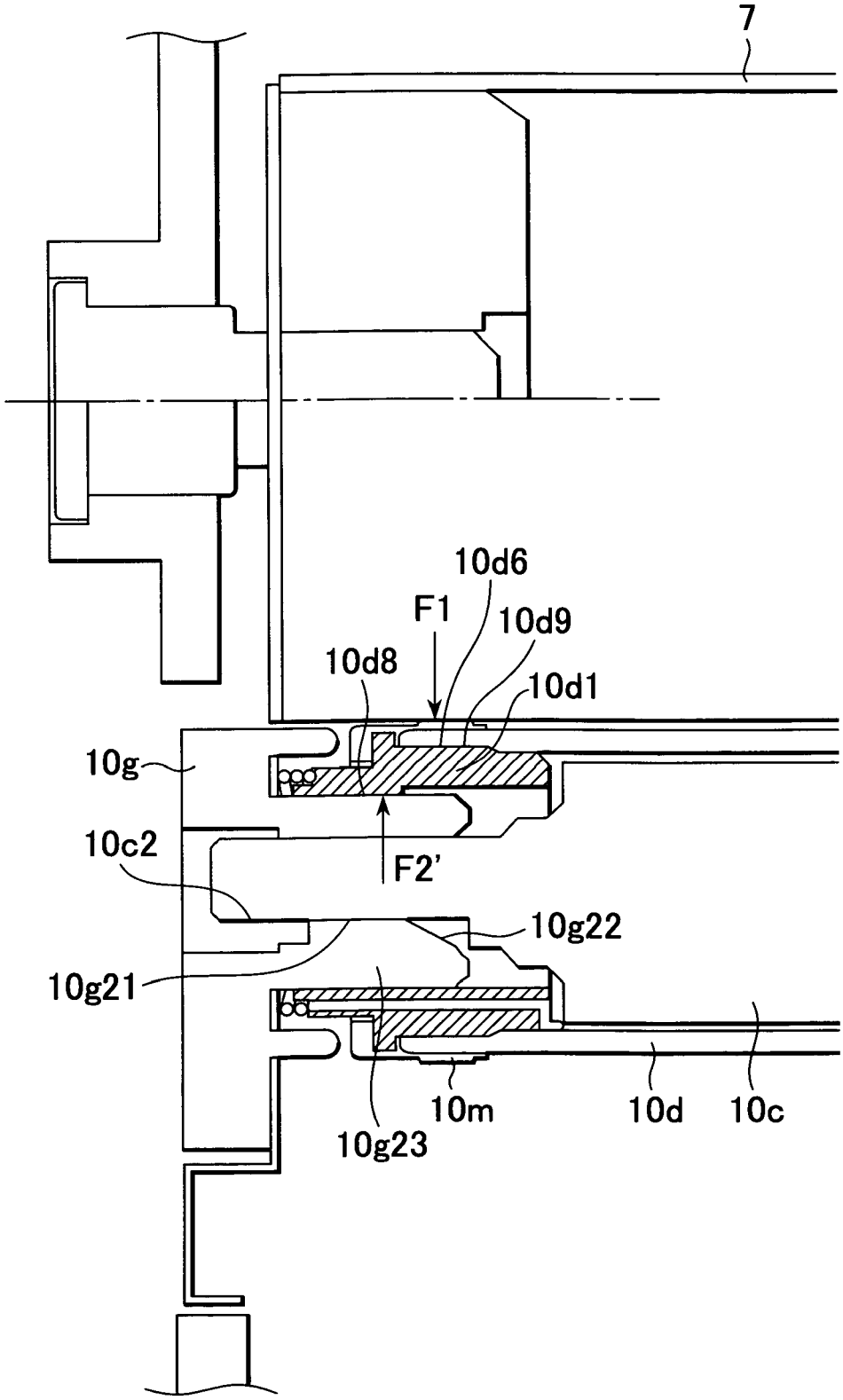
FIG. 10 is another sectional view illustrating the supporting structure of the developing roller.
Figure 11:
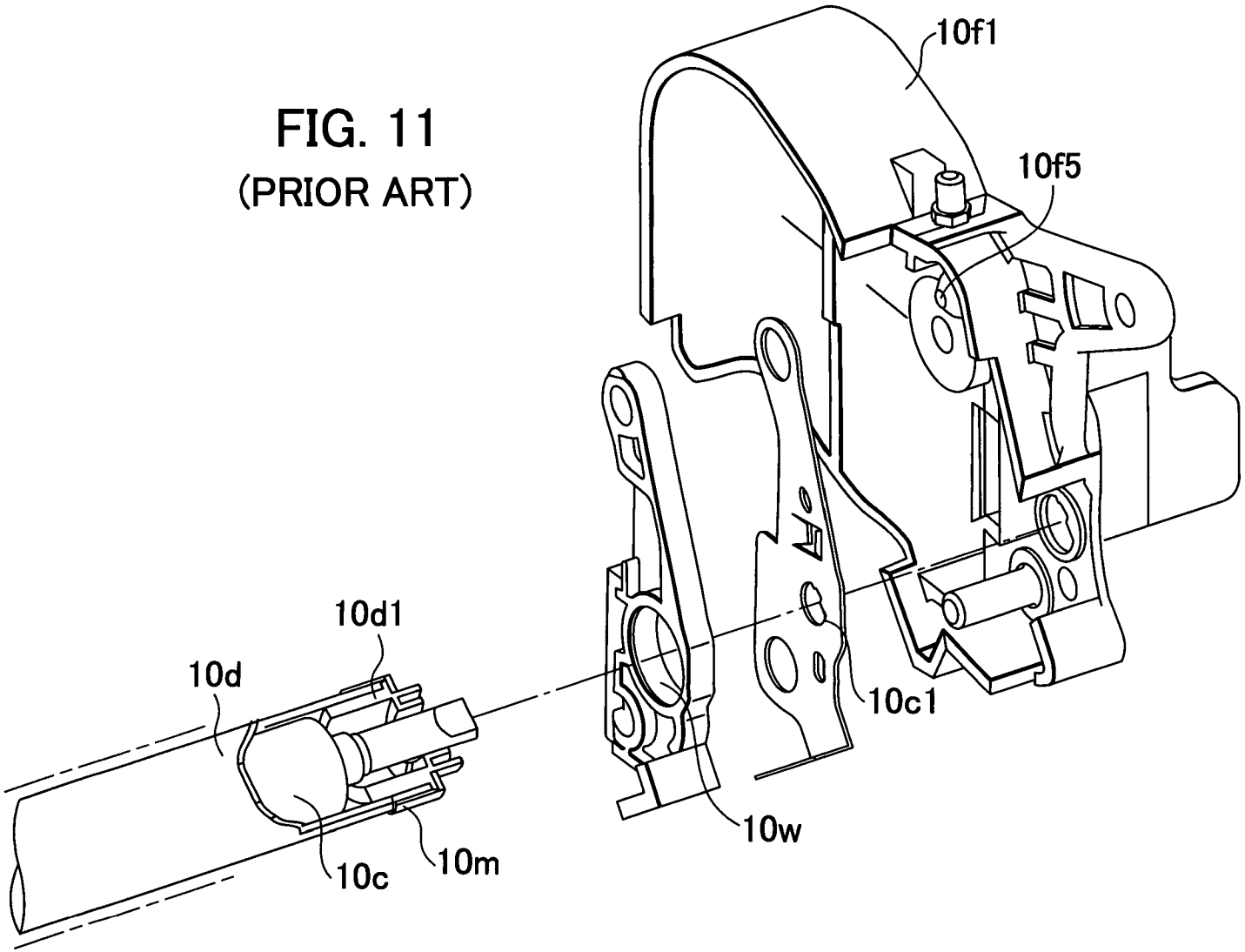
FIG. 11 (PRIOR ART)
FIG. 11 is a perspective view illustrating the supporting structure of a known developing roller.
Figure 12:
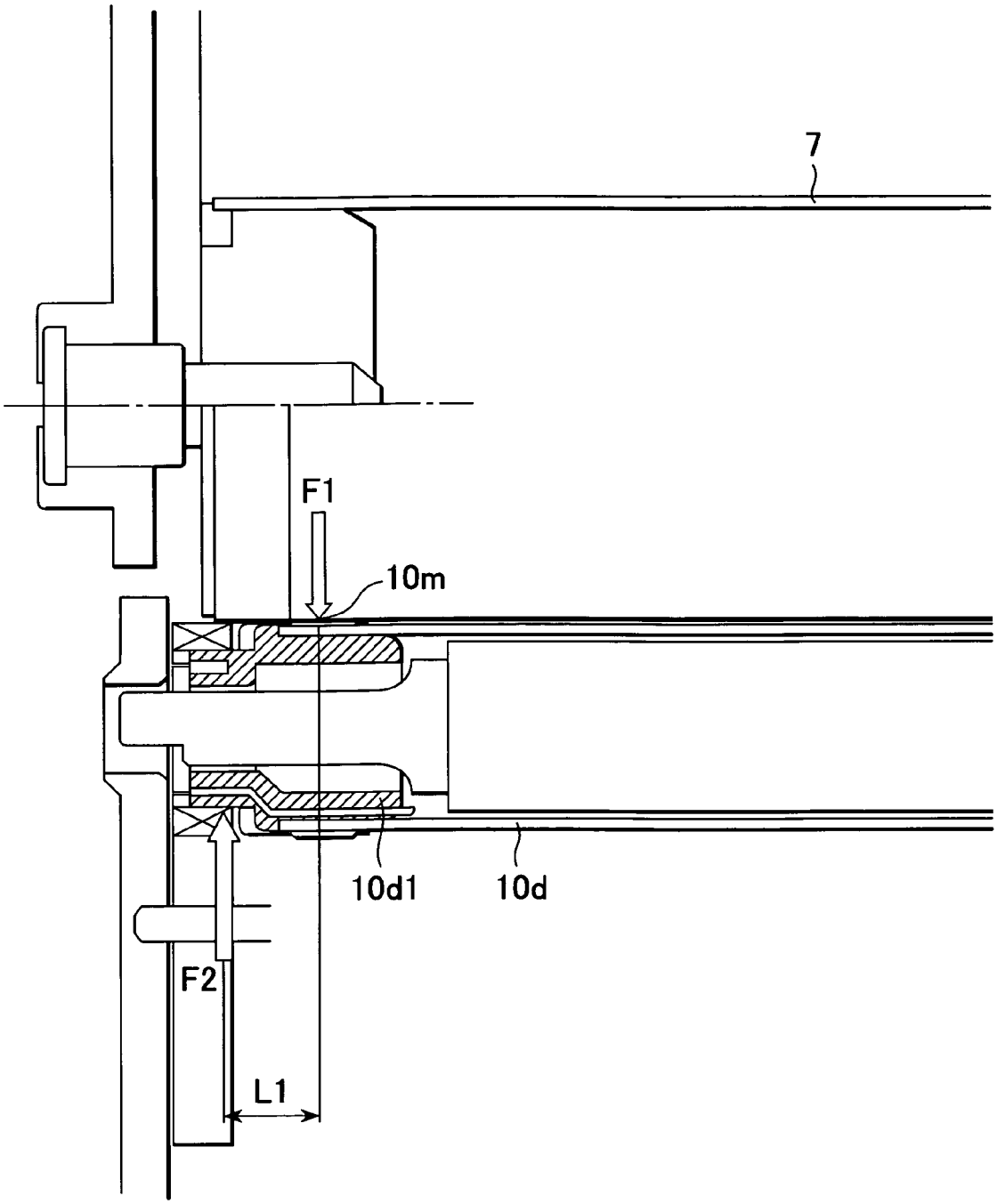
FIG. 12 (PRIOR ART)
FIG. 12 is a sectional view illustrating the supporting structure of the known developing roller shown in FIG. 10.

FIG. 10 is another sectional view illustrating the supporting structure of the developing roller 10*d*. The inner circumferential surface 10*d*8 of the flange 10*d*1 is deformed when the flange 10*d*1 is forcefully press-fitted into the corresponding end of the developing roller 10*d*. As such, the flange 10*d*1 is configured such that the press-fit portion 10*d*6, engaging with the inner circumferential surface 10*d*9 of the developing roller 10*d*, and the inner circumferential surface 10*d*8 of the flange 10*d*1, engaging with the outer circumference of the corresponding projection 10*g*23, are mutually displaced in the direction of the rotating axis of the developing roller 10*d*.

Since the developing roller 10*d* is press-fitted, a force exerted on the press-fit portion 10*d*6 does not affect the inner circumferential surface 10*d*8 of the developing-roller flange 10*d*1. As a result, deformation of the inner circumferential surface 10*d*8 is prevented, thereby preventing deformation of the developing roller 10*d* and accordingly reducing uneven toner density when performing toner development.

Even in such a state, each projection 10*g*23 is arranged so as to support the vicinity of a part pressed by the photosensitive drum 7, of the inner circumference of the flange 10*d*1 so that the force F1 from the photosensitive drum 7 and the reaction force F2 are exerted close to each other in the longitudinal direction of the developing roller.

Although the process cartridge according to the foregoing embodiment does not include cleaning means mounted thereon for cleaning the photoreceptor, the present invention is not limited to such a structure, and the present invention can be incorporated in a process cartridge having cleaning means mounted thereon.

As described above, according to the present invention, the gap between the electrophotographic receptor and the developing roller can be more uniformly kept.

While the present invention has been described with reference to the structures disclosed herein, it is not confined to the detailed set forth and this application is intended to cover such modifications or changes as may come within the purpose of the improvements or the scope of the following claims.

What is claimed is:

1. A developing device for developing an electrostatic latent image formed on an electrophotographic photoreceptor, comprising:

a hollow developing roller having an inner surface;

a support member inserted in the developing roller to support the developing roller, the support member having an outer surface;

a flange member having a first engaging portion engaging with the outer surface of the support member and a second engaging portion engaging with the inner surface of the developing roller; and a gap-holding member disposed at one end of the developing roller, the gap-holding member having an abutment abutting against the electrophotographic photoreceptor so as to maintain a gap between the developing roller and the electrophotographic photoreceptor, wherein the abutment overlaps with the second engaging portion in the longitudinal direction of the developing roller.

2. The developing device according to claim 1, wherein the abutment overlaps with the first engaging portion in the longitudinal direction of the developing roller.

3. The developing device according to claim 1, wherein the abutment lies in the second engaging portion in the longitudinal direction of the developing roller.

4. The developing device according to claim 1, further comprising a magnet disposed within the developing roller, wherein the support member comprises a positioning portion positioning the magnet relative to the developing roller; and a guide guiding the magnet to the positioning portion, wherein the guide rotates the magnet as the magnet is being inserted into the support member.

5. The developing device according to claim 1, wherein the second engaging portion extends further into the hollow developing roller in the longitudinal direction than the first engaging portion.

6. The developing device according to claim 1, wherein the first engaging portion engages rotatably with the outer surface of the support member.

7. The developing device according to claim 1, further comprising:

a developing frame supporting the developing roller; and an end member fixed to the developing frame, wherein the end member includes the support member protruding therefrom.

8. A demountable process cartridge for use with an electrophotographic image forming apparatus, comprising:

an electrophotographic photoreceptor;

a hollow developing roller developing an electrostatic latent image formed on the electrophotographic photoreceptor;

a support member inserted in the developing roller to support the developing roller;

a flange member having a first engaging portion engaging with an outer surface of the support member and a second engaging portion engaging with an inner surface of the developing roller; and a gap-holding member disposed at one end of the developing roller, the gap-holding member having an abutment abutting against the electrophotographic photoreceptor for maintaining a uniform gap between the developing roller and the electrophotographic photoreceptor, wherein the abutment overlaps with the second engaging portion in the longitudinal direction of the developing roller.

9. The demountable process cartridge according to claim 8, wherein the abutment overlaps with the first engaging portion in the longitudinal direction of the developing roller.

10. The process cartridge according to claim 8, wherein the abutment lies in the second engaging portion in the longitudinal direction of the developing roller.

11. The process cartridge according to claim 8, further comprising a magnet disposed in the developing roller, wherein the support member comprises a positioning portion positioning the magnet relative to the developing roller; and a guide guiding the magnet to the positioning portion, and wherein the guide rotates the magnet as the magnet is being inserted into the support member.

12. The process cartridge according to claim 8, wherein the second engaging portion extends further into the developing roller in the longitudinal direction than the first engaging portion.

13. The process cartridge according to claim 8, wherein the first engaging portion engages rotatably with the outer surface of the support member.

14. The process cartridge according to claim 8, further comprising a developing frame supporting the developing roller; and an end member fixed to the developing frame, wherein the end member includes the support member extending therefrom.

15. An image forming apparatus comprising:

an optical system;

a demountable process cartridge forming an image on a recording medium, including:

an electrophotographic photoreceptor, wherein the optical system emits light onto the photoreceptor to form an electrostatic latent image thereon;

a hollow developing roller developing the electrostatic latent image formed on the electrophotographic photoreceptor;

a support member inserted in the developing roller to support the developing roller;

a flange member having a first engaging portion engaging with an outer surface of the support member and a second engaging portion engaging with an inner surface of the developing roller; and a gap-holding member disposed at one end of the developing roller, the gap-holding member having an abutment abutting against the electrophotographic photoreceptor for maintaining a gap between the developing roller and the electrophotographic photoreceptor, wherein the abutment overlaps with the second engaging portion in the longitudinal direction of the developing roller;

fixing means for fixing the image onto the recording medium; and transporting means for transporting the recording medium to the process cartridge and to the fixing means.

16. The image forming apparatus of claim 15, wherein the abutment overlaps with the first engaging portion in the longitudinal direction of the developing roller.

* * * * *